US007156500B2

(12) United States Patent
Murai et al.

(10) Patent No.: US 7,156,500 B2
(45) Date of Patent: Jan. 2, 2007

(54) LIQUID-JET HEAD, METHOD FOR MANUFACTURING THE LIQUID-JET HEAD, AND LIQUID-JET APPARATUS

(75) Inventors: Masami Murai, Nagano-ken (JP); Miyuki Muramoto, Nagano-ken (JP); Takeshi Yasoshima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 226 days.

(21) Appl. No.: 10/874,702

(22) Filed: Jun. 24, 2004

(65) Prior Publication Data

US 2005/0030352 A1 Feb. 10, 2005

(30) Foreign Application Priority Data

Jun. 25, 2003 (JP) ..... 2003-181837
Jun. 3, 2004 (JP) ..... 2004-165975

(51) Int. Cl.
*B41J 2/045* (2006.01)

(52) U.S. Cl. ..... 347/68; 347/72

(58) Field of Classification Search ..... 347/68–72; 29/25.35

See application file for complete search history.

(56) References Cited

U.S. PATENT DOCUMENTS 6,499,837 B1 * 12/2002 Murai ..... 347/71
6,705,708 B1 3/2004 Murai
6,987,349 B1 1/2006 Murai

FOREIGN PATENT DOCUMENTS

JP 2000326503 A 11/2000

* cited by examiner

*Primary Examiner*—An H. Do
(74) *Attorney, Agent, or Firm*—Sughrue Mion, PLLC

(57) ABSTRACT

A lower electrode, which partially constitutes a piezoelectric element, is patterned such that at least one end face thereof is located in a region facing a corresponding pressure generating chamber. A piezoelectric layer includes a plurality of layers of ferroelectric films. A first ferroelectric film, which is a lowermost layer of the plurality of layers of ferroelectric films, is provided only on the lower electrode such that an end face thereof is aligned with the end face of the lower electrode. The end face of the first ferroelectric film and the end face of the lower electrode are sloped at an angle of 10° to 50° with respect to a vibration plate. Other ferroelectric films formed on the first ferroelectric film are provided in such a manner as to overlie the sloped end face of the lower electrode and the sloped end face of the first ferroelectric film.

9 Claims, 11 Drawing Sheets

LIQUID-JET HEAD, METHOD FOR MANUFACTURING THE LIQUID-JET HEAD, AND LIQUID-JET APPARATUS

BACKGROUND OF THE INVENTION

1. Field of the Invention

The present invention relates to a liquid-jet head for ejecting liquid droplets and to a method for manufacturing the liquid-jet head, as well as to a liquid-jet apparatus comprising the liquid-jet head. More particularly, the invention relates to an ink-jet recording head in which a vibration plate partially constitutes pressure generating chambers communicating with corresponding nozzle orifices, piezoelectric elements are formed on the surface of the vibration plate, and deflection of the piezoelectric elements causes eject of ink, and to a method for manufacturing the ink-jet recording head, as well as to an ink-jet recording apparatus comprising the ink-jet recording head.

2. Description of the Related Art

Ink-jet recording heads which have been put into practical use include two kinds in which a vibration plate partially constitutes pressure generating chambers communicating with corresponding nozzle orifices for ejecting ink droplets, and piezoelectric elements cause the vibration plate to be deformed so as to apply pressure to ink contained in the corresponding pressure generating chambers to thereby eject ink droplets from corresponding nozzle orifices. One such kind of ink-jet recording head uses piezoelectric actuators that operate in the longitudinal vibration mode; i.e., piezoelectric actuators that extend and contract in the axial direction of the piezoelectric elements. The other kind of ink-jet recording head uses piezoelectric actuators that operate in the flexural vibration mode.

A known ink-jet recording head using piezoelectric actuators that operate in the flexural vibration mode is manufactured, for example, in such a manner that a piezoelectric layer is uniformly formed on the entire surface of a vibration plate by film forming technique; and the piezoelectric layer is lithographically divided into portions corresponding to pressure generating chambers, thereby forming independent piezoelectric elements corresponding to the pressure generating chambers.

An ink-jet recording head using such piezoelectric elements has a structure in which lower electrodes of the corresponding piezoelectric elements are patterned so as to correspond to pressure generating chambers to thereby suppress initial deflection of a vibration plate, thereby increasing working deflection of the vibration plate effected by actuation of a piezoelectric element (refer to, for example, Japanese Patent Application Laid-Open (kokai) No. 2000-326503 (FIG. 7)).

However, formation of a piezoelectric layer on the patterned lower electrodes results in poor film quality of a portion of the piezoelectric layer that overlies the vibration plate and end portions of the lower electrodes, resulting in low reliability of driving performance. Specifically, a portion of the piezoelectric layer overlying the lower electrodes differs in properties such as crystallinity from a portion of the piezoelectric layer overlying the vibration plate. As a result, the piezoelectric layer becomes substantially discontinuous in a region in the vicinity of the end portions of the lower electrodes. When voltage is applied to the piezoelectric layer, such discontinuity causes occurrence of fracture, such as cracking, of the piezoelectric layer. Particularly, the piezoelectric layer tends to be fractured in a region corresponding to longitudinal end portions of the lower electrodes. Such a problem arises in not only ink-jet recording heads that eject ink, but also liquid-jet heads that eject droplets of liquid other than ink.

SUMMARY OF THE INVENTION

In view of the foregoing, an object of the present invention is to provide a liquid-jet head in which fracture of a piezoelectric layer can be prevented to thereby provide a piezoelectric element having stable deflection characteristics, and a method for manufacturing the liquid-jet head, as well as a liquid-jet apparatus comprising the liquid-jet head.

To achieve the above object, the present invention provides a liquid-jet head which comprises a passage-forming substrate having a pressure generating chamber formed therein and communicating with a nozzle orifice for ejecting liquid; and a piezoelectric element provided on one side of the passage-forming substrate via a vibration plate, the piezoelectric element comprising a lower electrode, a piezoelectric layer, and an upper electrode. The lower electrode is patterned such that at least one end face thereof is located in a region facing the pressure generating chamber. The piezoelectric layer comprises a plurality of layers of ferroelectric films. A first ferroelectric film, which is a lowermost layer of the plurality of layers of ferroelectric films, is provided only on the lower electrode such that an end face thereof is aligned with the end face of the lower electrode. The end face of the first ferroelectric film and the end face of the lower electrode are sloped at an angle of 10° to 50° with respect to the vibration plate. Other ferroelectric films formed on the first ferroelectric film are provided in such a manner as to overlie the sloped end face of the lower electrode and the sloped end face of the first ferroelectric film.

The above configuration improves crystallinity of the piezoelectric layer at a portion in the vicinity of an end portion of the lower electrode, thereby preventing fracture of the piezoelectric layer, which could otherwise result from application of voltage, and enhancing reliability of driving performance of the piezoelectric element.

Preferably, in the liquid-jet head of the present invention, the end face of the first ferroelectric film and the end face of the lower electrode are sloped at an angle equal to or less than 40°.

Employment of a slope angle of 40° or less reliably improves crystallinity of the piezoelectric layer at a portion in the vicinity of an end portion of the lower electrode.

Preferably, in the liquid-jet head of the present invention, the first ferroelectric film and a second ferroelectric film formed on the first ferroelectric film are thinner than each of other, remaining ferroelectric films formed on the second ferroelectric film.

Employment of the above thickness feature reliably enhances film quality of the first and second ferroelectric films, resulting in attendant enhancement of film quality of other ferroelectric films formed on the second ferroelectric film.

Preferably, in the liquid-jet head of the present invention, crystal seeds, which serve as crystal nuclei of the piezoelectric layer, are formed on the first ferroelectric film and on the vibration plate in a continuously overlying manner.

As a result of the above formation of crystal seeds, crystals of the second ferroelectric film are oriented in the same direction and formed in a substantially uniform condition, thereby reliably enhancing film quality of the piezoelectric layer.

The present invention provides a liquid-jet apparatus comprising a liquid-jet head of the present invention.

Employment of the liquid-jet head of the present invention imparts enhanced reliability to a liquid-jet apparatus.

The present invention provides a method for manufacturing a liquid-jet head, comprising the steps of, after forming a lower electrode film, forming a piezoelectric layer comprising a plurality of layers of ferroelectric films, on the lower electrode film, which is formed via a vibration plate on a passage-forming substrate in which a pressure generating chamber communicating with a nozzle orifice for ejecting liquid is to be formed; and, after forming an upper electrode film on the piezoelectric layer, forming a piezoelectric element by means of patterning the upper electrode film and the piezoelectric layer. The step of forming the piezoelectric layer comprises the steps of forming a first ferroelectric film, which is a lowermost layer of the plurality of layers of ferroelectric films, by means of forming on the lower electrode film a ferroelectric precursor film having a predetermined thickness, and firing the ferroelectric precursor film; patterning the lower electrode film and the first ferroelectric film such that one end portion of the lower electrode film and one end portion of the first ferroelectric film are located in a region facing a region of the pressure generating chamber and such that an end face of the end portion of the lower electrode film and an end face of the end portion of the first ferroelectric film are sloped at a predetermined angle with respect to the vibration plate; and forming the plurality of layers of ferroelectric films by means of repeating, a plurality of times, a step of forming at least a single layer of ferroelectric precursor film on the first ferroelectric film and firing the ferroelectric precursor film (s).

The above manufacturing method of the present invention enhances film quality of the piezoelectric layer; particularly, film quality of the piezoelectric layer at a portion in the vicinity of the end face of the lower electrode film.

Preferably, in the manufacturing method of the present invention, in the step of forming the plurality of ferroelectric films, a second ferroelectric film is formed on the first ferroelectric film in such a manner as to be thinner than each of other, remaining ferroelectric films to be formed on the second ferroelectric film.

Employment of the above thickness feature enhances film quality of the second ferroelectric film, resulting in attendant enhancement of film quality of the entire piezoelectric layer.

Preferably, in the manufacturing method of the present invention, one layer of ferroelectric precursor film is formed and fired to thereby form the second ferroelectric film; and two or more layers of ferroelectric precursor films are formed and then fired to thereby form the other remaining ferroelectric films.

Employment of the above process enhances film quality of the piezoelectric layer and manufacturing efficiency.

Preferably, the manufacturing method of the present invention further comprises a step of forming crystal seeds, which serve as crystal nuclei of the piezoelectric layer, on the first ferroelectric film and on the vibration plate in a continuously overlying manner, the step following the step of patterning the lower electrode film and the first ferroelectric film.

As a result of employment of the above step of forming crystal seeds, crystals of the second ferroelectric film are oriented in the same direction and formed in a substantially uniform condition, thereby reliably enhancing film quality of the piezoelectric layer.

Preferably, in the manufacturing method of the present invention, when resist applied on the first ferroelectric film is to undergo exposure in order to form a resist film for use in patterning the lower electrode film and the first ferroelectric film, light to be applied to the resist is focused on a surface of the first ferroelectric film or on a position biased toward the lower electrode film from the surface of the first ferroelectric film.

The above practice can slope the end face of the resist film with relative ease. By means of patterning the lower electrode and the first ferroelectric film via the resist film having the sloped end face, the end face of the lower electrode film and the end face of the first ferroelectric film can be sloped with relative ease.

Preferably, in the manufacturing method of the present invention, the lower electrode film and the first ferroelectric film are patterned by means of ion milling.

Through employment of ion milling, the lower electrode film and the first ferroelectric film can be formed into a predetermined pattern with relative ease.

Preferably, in the manufacturing method of the present invention, the ferroelectric precursor films are formed by a sol-gel process.

Through employment of a sol-gel process, the piezoelectric layer can be formed with good film quality and with relative ease.

The present invention also provides an actuator device comprising a substrate; a vibration plate provided on one face of the substrate; and a piezoelectric element provided on the vibration plate and including a lower electrode, a piezoelectric layer, and an upper electrode. The lower electrode of the piezoelectric element is formed through patterning. The piezoelectric layer comprises a plurality of layers of ferroelectric films. A first ferroelectric film, which is a lowermost layer of the plurality of layers of ferroelectric films, is provided only on the lower electrode such that an end face thereof is aligned with the end face of the lower electrode. The end face of the first ferroelectric film and the end face of the lower electrode are sloped at an angle of 10° to 50° with respect to the vibration plate. Other ferroelectric films formed on the first ferroelectric film are provided in such a manner as to overlie the sloped end face of the lower electrode and the sloped end face of the first ferroelectric film.

The above configuration improves crystallinity of the piezoelectric layer at a portion in the vicinity of an end portion of the lower electrode, thereby preventing fracture of the piezoelectric layer, which could otherwise result from application of voltage, and enhancing reliability of driving performance of the piezoelectric element.

Preferably, the end face of the first ferroelectric film and the end face of the lower electrode are sloped at an angle equal to or less than 40°.

Employment of a slope angle of 40° or less reliably improves crystallinity of the piezoelectric layer at a portion in the vicinity of an end portion of the lower electrode.

Preferably, the first ferroelectric film and a second ferroelectric film formed on the first ferroelectric film are thinner than each of other, remaining ferroelectric films formed on the second ferroelectric film.

Employment of the above thickness feature reliably enhances film quality of the first and second ferroelectric films, resulting in attendant enhancement of film quality of other ferroelectric films formed on the second ferroelectric film.

Preferably, crystal seeds, which serve as crystal nuclei of the piezoelectric layer, are formed on the first ferroelectric film and on the vibration plate in a continuously overlying manner.

As a result of the-above formation of crystal seeds, crystals of the second ferroelectric film are oriented in the same direction and formed in a substantially uniform condition, thereby reliably enhancing film quality of the piezoelectric layer.

DESCRIPTION OF THE PREFERRED EMBODIMENTS

Embodiments of the present invention will next be described in detail with reference to the drawings.

Figure 1:
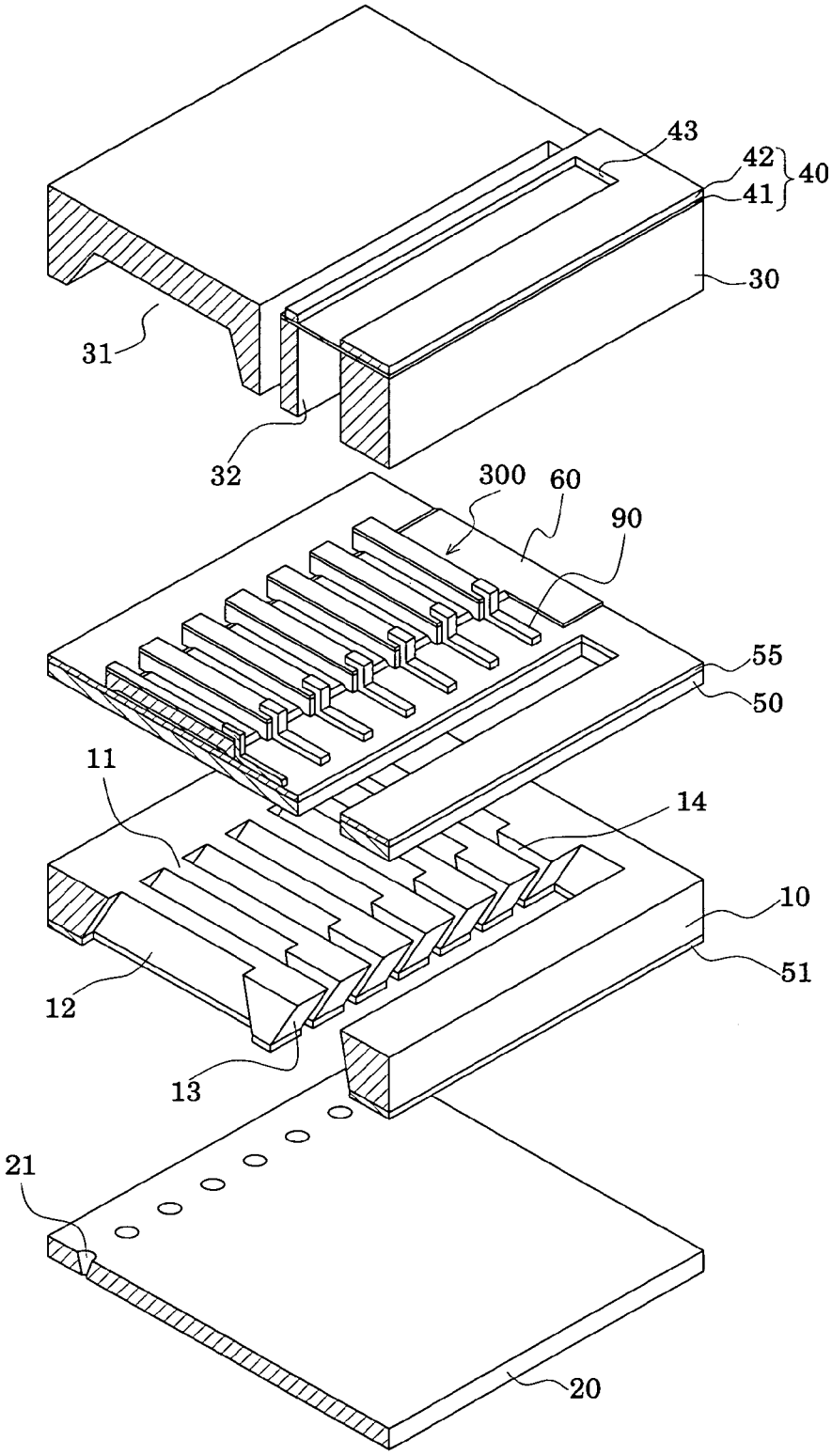
FIG. 1 is an exploded perspective view of an ink-jet recording head according to an embodiment of the present invention.
Figure 2A:
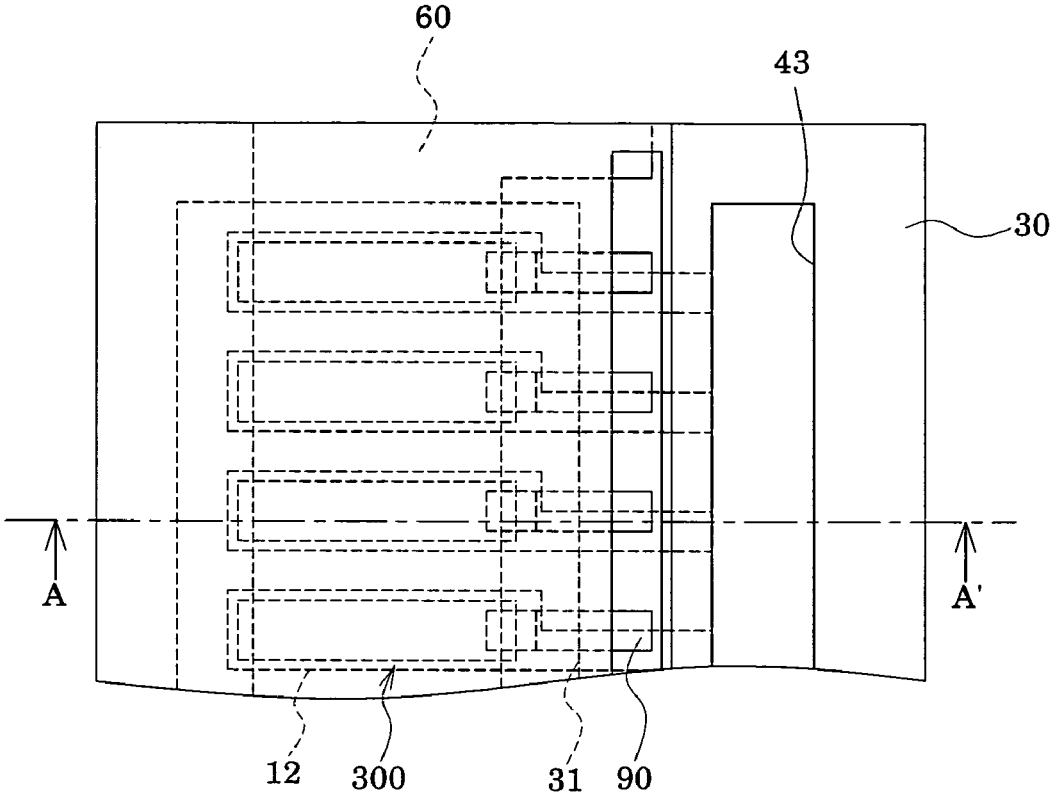
FIG. 2A is a plan view of the ink-jet recording head according to the embodiment.
Figure 2B:
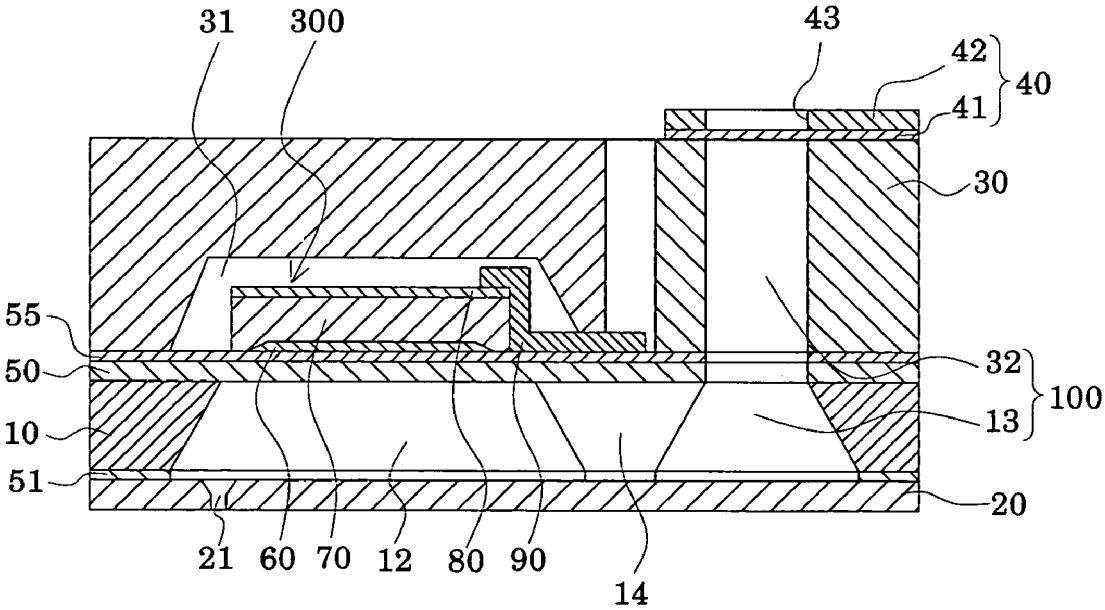
FIG. 2B is a sectional view taken along line A–A' of FIG. 2A.
Figure 3:
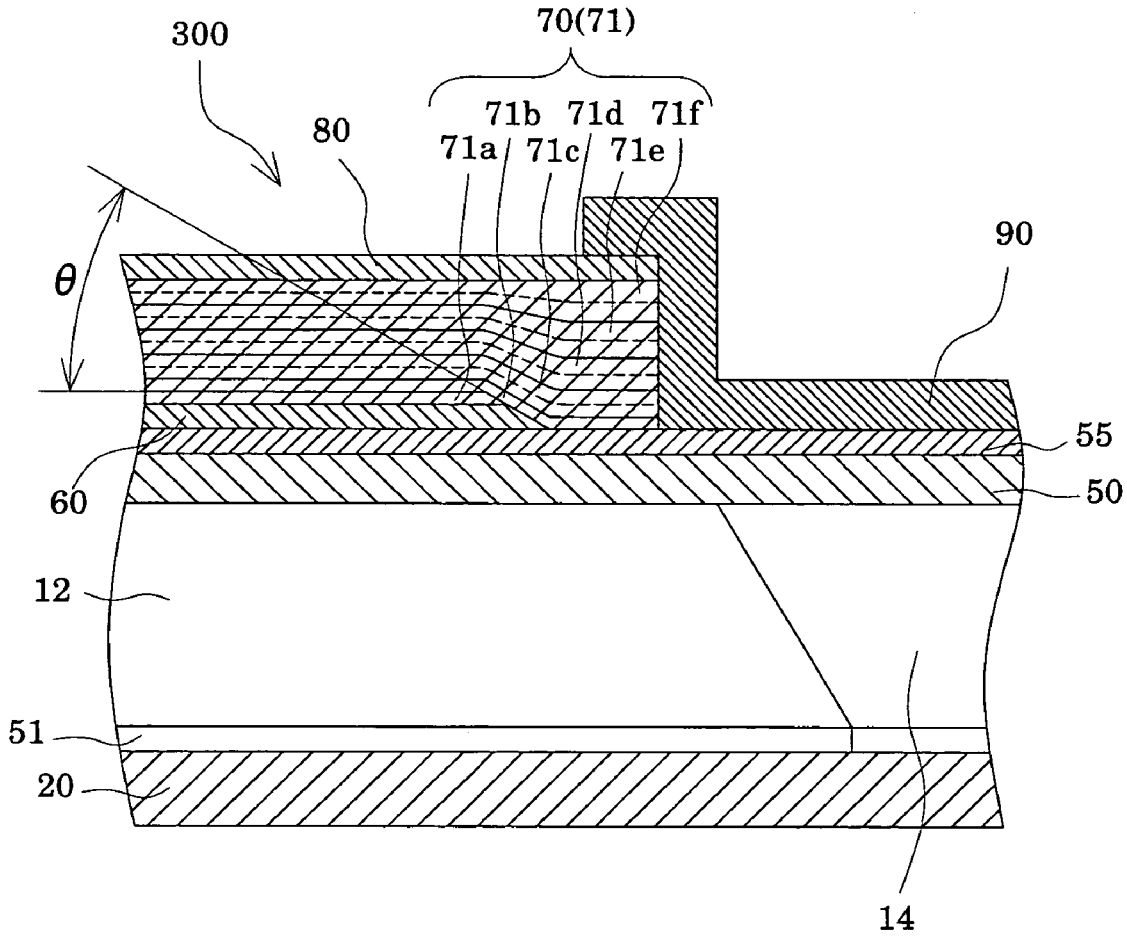
FIG. 3 is a schematic sectional view showing the layer structure of a piezoelectric element of the ink-jet recording head according to the embodiment.

FIGS. 1 and 2 show an ink-jet recording head according to an embodiment of the present invention. FIG. 3 shows the layer structure of a piezoelectric element 300. In the present embodiment, a passage-forming substrate 10 is formed of a monocrystalline silicon substrate having a crystal face orientation of (110). An elastic film 50 is formed beforehand on one side of the passage-forming substrate 10 by means of thermal oxidation. The elastic film 50 is formed of silicon dioxide and has a thickness of 1 μm to 2 μm. In the passage-forming substrate 10, a plurality of pressure generating chambers 12 are provided in proximity in a row arrangement in their width direction. A communication section 13 is formed in the passage-forming substrate 10 in a region located longitudinally outside the pressure generating chambers 12. The communication section 13 communicates with the pressure generating chambers 12 via corresponding ink supply channels 14. The communication section 13 communicates with a reservoir section 32 of a sealing substrate 30, which will be described later, and partially constitutes a reservoir 100, which serves as a common ink chamber for the pressure generating chambers 12. The ink supply channels 14 are formed narrower than the pressure generating chambers 12 so as to maintain constant flow resistance of ink flowing into the pressure generating chambers 12 from the communication section 13.

A nozzle plate 20 is bonded to the orifice side of the passage-forming substrate 10 via adhesive, a thermally fusing film, or the like. Nozzle orifices 21 are formed through the nozzle plate 20 and communicate with the corresponding pressure generating chambers 12 at end portions opposite the ink supply channels 14.

As described above, the elastic film 50 having a thickness of, for example, about 1.0 μm is formed on a side of the passage-forming substrate 10 opposite the orifice side. An insulator film 55 having a thickness of, for example, about 0.4 μm is formed on the elastic film 50. A lower electrode film 60 having a thickness of, for example, about 0.2 μm, a piezoelectric layer 70 having a thickness of, for example, about 1.0 μm, and an upper electrode film 80 having a thickness of, for example, about 0.05 μm are formed in layers on the insulator film 55 by a process to be described later, thereby forming the piezoelectric elements 300. Herein, the piezoelectric element 300 refers to a section that includes the lower electrode film 60, the piezoelectric layer 70, and the upper electrode film 80. Generally, either the lower electrode or the upper electrode of the piezoelectric element 300 assumes the form of a common electrode for use among the piezoelectric elements 300, whereas the other electrode and the piezoelectric layer 70 are formed, through patterning, for each of the pressure generating chambers 12. The other electrode and the piezoelectric layer 70 formed through patterning constitute an active piezoelectric section, which produces a piezoelectric strain when voltage is applied between the upper and lower electrodes. According to the present embodiment, the lower electrode film 60 serves as a common electrode for use among the piezoelectric elements 300, whereas the upper electrode film 80 serves as an individual electrode for use with a piezoelectric element 300. However, the configuration may be reversed in accordance with needs of a drive circuit and wiring. In either case, active piezoelectric sections are formed individually for corresponding pressure generating chambers. Herein, a piezoelectric element 300 and a vibration plate, which is deflected through activation of the piezoelectric element 300, constitute a piezoelectric actuator.

The lower electrode film 60, which partially constitutes the piezoelectric element 300, is patterned in such a manner as to be terminated in the vicinity of opposite ends of each of the pressure generating chambers 12, and provided continuously along the direction of row arrangement of the pressure generating chambers 12. In a region corresponding to each of the pressure generating chambers 12, an end face of the lower electrode film 60 is sloped at a predetermined angle θ with respect to the insulator film 55.

The piezoelectric layer 70 is provided independently for each of the pressure generating chambers 12 and is, as shown in FIG. 3, composed of a plurality of layers of ferroelectric films 71 (71*a* to 71*f*). A first ferroelectric film 71*a*, which is a lowermost layer of the plurality of layers of the ferroelectric films 71, is provided only on the lower electrode film 60. An end face of the first ferroelectric film 71*a* is sloped and aligned with the end face of the lower electrode film 60. Second to sixth ferroelectric films 71*b* to 71*f* are formed on the first ferroelectric film 71*a* and extend onto the insulator film 55 while overlying the sloped end face of the first ferroelectric film 71*a* and the sloped end face of the lower electrode film 60.

In the present invention, the end face of the lower electrode film 60 and the end face of the first ferroelectric film 71*a* are sloped at an angle θ of about 10° to 50°, preferably 40° or less, with respect to the insulator film 55. Employment of such an angle enhances crystal orientation and denseness of the ferroelectric films 71, thereby enhancing film quality of the piezoelectric layer 70. For example, in the present embodiment, the end face of the lower electrode film 60 and the end face of the first ferroelectric film 71*a* are sloped at an angle θ of about 25°.

The lower electrode film 60 and the first ferroelectric film 71*a* are preferably small in the end face angle θ. However, an angle θ less than 10° significantly impairs accuracy in forming the end face of the lower electrode film 60. An angle θ greater than 50° impairs crystallinity of the second to sixth ferroelectric films 71*b* to 71*f*, which are formed on the first ferroelectric film 71*a*. In view of crystallinity and accuracy in forming the end face, the present embodiment employs an end face angle θ of 25° for the lower electrode film 60 and for the first ferroelectric film 71*a*.

As shown in FIG. 3, as compared with the end face angle of the lower electrode film 60 and the end face angle of the first ferroelectric film 71*a*, sloped portions of the other ferroelectric films 71*b* to 71*f*, which are formed on the first ferroelectric film 71*a*, gradually decrease in angle in the direction from the ferroelectric film 71*b* to the ferroelectric film 71*f*. As a result, the upper face of the piezoelectric layer 70, which consists of the plurality of ferroelectric films 71*b* to 71*f*, becomes substantially flat. Thus, the upper electrode film 80 can be formed in a favorable condition.

In the present embodiment, the first ferroelectric film 71*a* and the second ferroelectric film 71*b*, which is formed on the first ferroelectric film 71*a*, are formed higher in crystal density than the remaining third to sixth ferroelectric films 71*c* to 71*f*. Preferably, the first ferroelectric film 71*a* and the second ferroelectric film 71*b* are formed thinner than the third to sixth ferroelectric films 71*c* to 71*f*. For example, in the present embodiment, the first and second ferroelectric films 71*a* and 71*b* are formed to a film thickness of about 0.1 μm, whereas the other ferroelectric films 71*c* to 71*f* are formed to a film thickness of about 0.2 μm. Employment of such thickness feature enhances manufacturing efficiency while good crystallinity of the ferroelectric films 71 is maintained.

As in the case of the piezoelectric layer 70, the upper electrode film 80 is provided for each of the pressure generating chambers 12. Lead electrodes 90 are connected to the corresponding upper electrode films 80. The lead electrodes 90 are formed of, for example, gold (Au) and extend from the corresponding upper electrode films 80 to the insulator film 55.

The sealing substrate 30 is bonded to the side of the passage-forming substrate 10 on which the piezoelectric elements 300 are formed, such that a space for allowing free movement of the piezoelectric elements 300 is provided in a region facing the piezoelectric elements 300. The sealing substrate 30 is formed of a monocrystalline silicon substrate and has a piezoelectric-element accommodation section 31 that can seal the space. The sealing substrate 30 includes the reservoir section 32. The reservoir section 32 at least partially constitutes the reservoir 100, which serves as a common ink chamber for the pressure generating chambers 12. A compliance substrate 40 is bonded onto the sealing substrate 30. The compliance substrate 40 includes a sealing film 41, which is formed of a flexible material having low rigidity, and a fixing plate 42, which is formed of a hard, rigid material. A region of the fixing plate 42 that faces the reservoir 100 is completely removed in the thickness direction of the fixing plate 42, thereby forming an opening portion 43. As a result, one side of the reservoir 100 is sealed merely with the sealing film 41.

The thus-configured ink-jet recording head of the present embodiment operates in the following manner. Unillustrated external ink supply means supplies ink to the ink-jet recording head. The thus-supplied ink fills an internal space extending from the reservoir 100 to the nozzle orifices 21. Subsequently, in accordance with a record signal from an unillustrated drive circuit, voltage is applied via external wiring between the upper electrode film 80 and the lower electrode film 60 corresponding to each of the pressure generating chambers 12, thereby causing the elastic film 50, the insulator film 55, the lower electrode film 60, and the piezoelectric layer 70 to be deformed in a deflected manner. As a result, pressure within the pressure generating chambers 12 increases, thereby causing ink droplets to be ejected from the corresponding nozzle orifices 21.

Figure 4A:
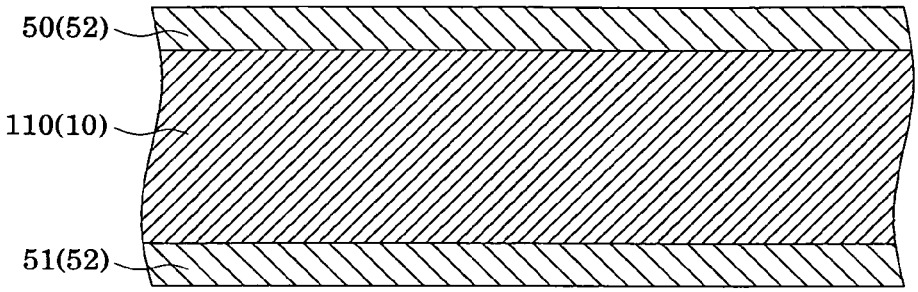
FIGS. 4A to 4C are sectional views showing steps of manufacturing the ink-jet recording head according to the embodiment.
Figure 4B:
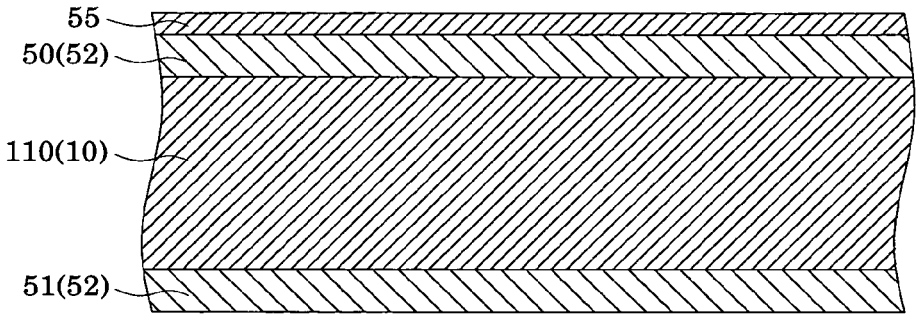
Figure 4C:
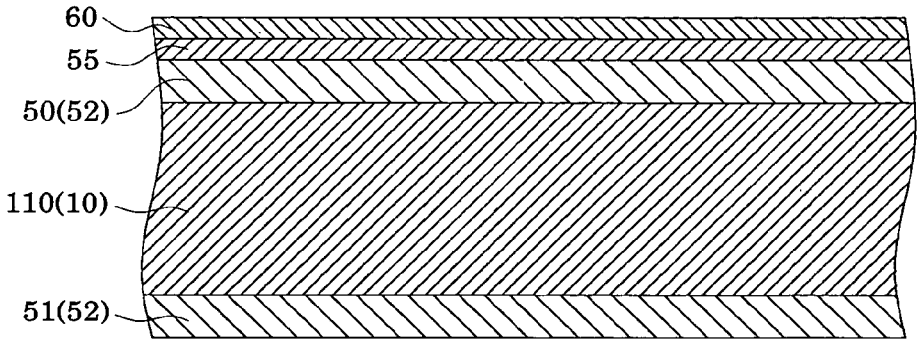

A method for manufacturing the ink-jet recording head according to the present embodiment; particularly, a method for forming the piezoelectric elements 300, will be described with reference to FIGS. 4 to 8. First, as shown in FIG. 4A, a silicon wafer 110, from which the passage-forming substrates 10 are formed, is thermally oxidized at about 1100° C. in a diffusion furnace, thereby forming silicon dioxide films 52, which serve as the elastic film 50 and a mask film 51, on the entire opposite surfaces of the silicon wafer 110. Next, as shown in FIG. 4B, after a zirconium (Zr) layer is formed on the elastic film 50 (silicon dioxide film 52), the silicon wafer 110 is thermally oxidized at, for example, 500° C. to 1,200° C. in the diffusion furnace, thereby forming the insulator film 55, which is formed of zirconium oxide ($ZrO_2$). Next, as shown in FIG. 4C, the lower electrode film 60 is formed on the insulator film 55 by use of platinum and iridium. Platinum, iridium, and the like are preferred as material for the lower electrode film 60. This is because, after the piezoelectric film 70, which will be described later, is formed by a sputtering process or a sol-gel process, the piezoelectric film 70 must be crystallized by means of firing at a temperature of about 600° C. to 1,000° C. in the atmosphere or an oxygen atmosphere. In other words, material for the lower electrode film 60 must be able to maintain electrical conductivity in such a high-temperature, oxidizing atmosphere. As in the case of the present embodiment, when lead zirconate titanate (PZT) is used to form the piezoelectric layer 70, it is desirable that a change in electrical conductivity caused by diffusion of lead oxide is small. Therefore, platinum, iridium, and the like are preferred.

Next, the piezoelectric layer 70 is formed on the lower electrode film 60. As mentioned above, the piezoelectric layer 70 assumes the form of a plurality of layers of ferroelectric films 71*a* to 71*f*. In the present embodiment, the ferroelectric films 71 are formed by use of a so-called sol-gel process. In other words, a metallic organic substance is dissolved and dispersed in catalyst to thereby obtain sol. The sol is applied onto the lower electrode film 60 and dried, thereby forming a ferroelectric precursor film 72. The ferroelectric precursor film 72 is debindered so as to desorb organic components, followed by firing for crystallization. In this manner, the ferroelectric films 71 are formed.

Figure 5A:
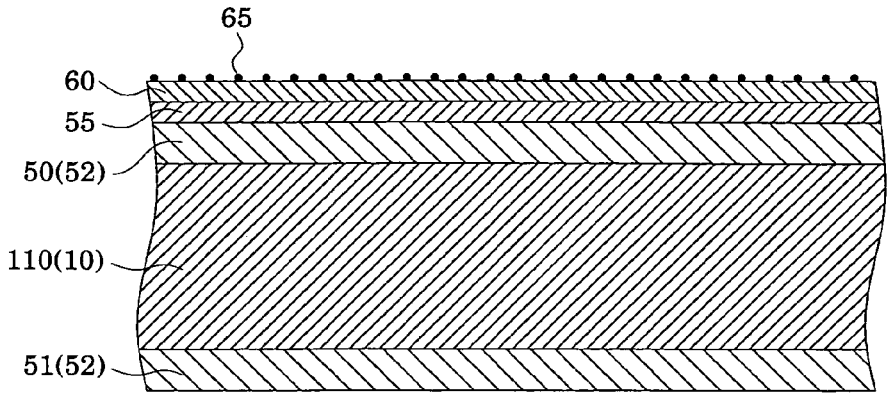
FIGS. 5A to 5C are sectional views showing steps of manufacturing the ink-jet recording head according to the embodiment.
Figure 5B:
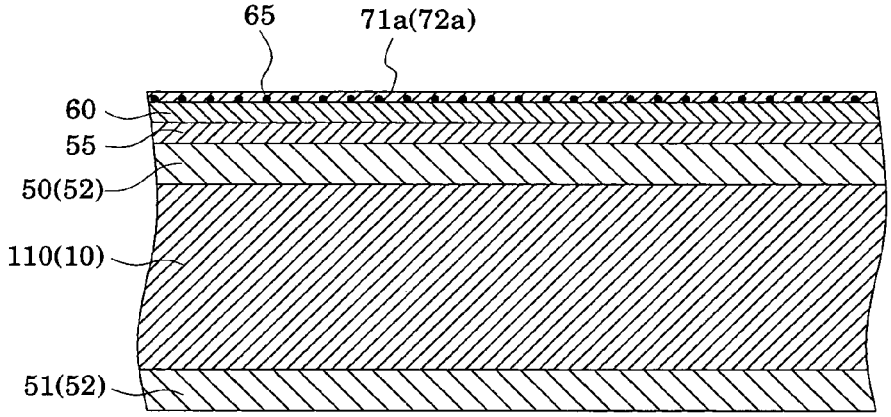

Specifically, first, as shown in FIG. 5A, crystal seeds (layer) 65 of titanium or titanium oxide are formed on the lower electrode film 60 by a sputtering process. Next, as shown in FIG. 5B, an uncrystallized ferroelectric precursor film 72*a* is formed by a spin-coating process or the like to a predetermined thickness; in the present embodiment, to a thickness such that thickness as measured after firing becomes about 0.1 μm. Notably, in a single coating, the ferroelectric precursor film 72*a* is formed to a thickness of about 0.15 μm. Next, the ferroelectric precursor film 72*a* is dried at a predetermined temperature for a predetermined time so as to evaporate solvent. The ferroelectric precursor film 72*a* is dried at a temperature of, for example, 150° C. to 200° C.; preferably about 180° C. The drying time is, for example, 5 minutes to 15 minutes, preferably about 10 minutes.

The dried ferroelectric precursor film 72*a* is debindered at a predetermined temperature. Herein, the term "debinder" means to desorb organic components, such as $NO_2$, $CO_2$, and $H_2O$, from the ferroelectric precursor film 72*a*. In the debindering step, a preferred range of temperature for heating the silicon wafer 110 is 300° C. to 500° C. Excessively high temperature starts crystallization of the ferroelectric precursor film 72*a*; and excessively low temperature results in insufficient debindering. In the present embodiment, the silicon wafer 110 is heated to about 400° C. by use of a hot plate, thereby debindering the ferroelectric precursor film 72*a*. Preferably, the rate of temperature increase in this debindering step is lower than that in forming the third to sixth ferroelectric films 71*c* to 71*f* in a later step. Specifically, for example, when temperature is increased from 250° C. to 400° C., a preferred rate of temperature increase is about 1.5° C./sec to 2° C./sec. Employment of such a rate of temperature increase allows generation of a large number of crystal nuclei in the ferroelectric precursor film 72*a*, thereby enhancing crystal denseness and orientation of the first ferroelectric film 71*a*, which is obtained through firing in a later step, which will be described later.

After the ferroelectric precursor film 72*a* is debindered as described above, the silicon wafer 110 is placed in a predetermined diffusion furnace. The ferroelectric precursor film 72*a* is crystallized by means of firing at a high temperature of about 700° C. Thus is formed the first ferroelectric film 71*a*, which is a ferroelectric film closest to the lower electrode film 60.

Figure 5C:
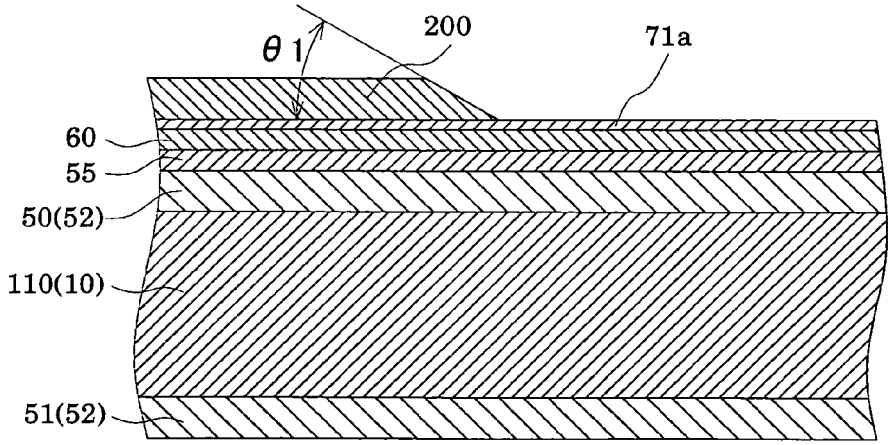

After the first ferroelectric film 71*a* is formed as described above, the lower electrode film 60 and the first ferroelectric film 71*a* are simultaneously patterned. Patterning is performed such that the end face of the lower electrode film 60 and the end face of the ferroelectric film 71*a* are sloped at an angle of about 10° to 50°; in the present embodiment, at an angle of about 25°. Specifically, first, as shown in FIG. 5C, resist is applied onto the first ferroelectric film 71*a*. The resist is, for example, a mixture of phenol novolak resin and a photosensitive agent. The applied resist is exposed by use of a mask and then developed, thereby forming a resist film 200 in a predetermined pattern. Specifically, for example, negative resist is applied by a spin-coating process. The applied negative resist is exposed by use of a predetermined mask, followed by development and baking to thereby form the resist film 200. In place of negative resist, positive resist may be used. The resist film 200 is formed such that its end face is sloped at an angle θ1 of about 25° with respect to the first ferroelectric film 71*a*.

In the case where the slope angle θ1 of the resist film 200 is set relatively small as mentioned above, conditions of forming the resist film 200 are preferably adjusted as follows: temperature of postbaking the resist film 200 is 150° C. or higher; and postbaking time is set relatively long. Employment of such postbaking conditions increases sag of an end portion of the resist film 200 when the resist film 200 is postbaked, whereby the end face of the resist film 200 can assume a relatively small slope angle θ1.

Preferably, the thickness of the resist film 200 is greater than at least that of the first ferroelectric film 71*a* and that of the lower electrode film 60. For example, the resist film 200 is formed relatively thick to a thickness of 1.5 μm or greater. Employment of a thick resist film 200 increases sag at the time of postbaking, whereby the end face of the resist film 200 can assume a relatively small slope angle θ1. For example, at a postbaking temperature of 170° C., the slope angle θ1 of the resist film 200 became about 30° at a thickness of 1.53 μm, and about 23° at a thickness of 2.26 μm.

Preferably, a resin having a relatively wide molecular-weight distribution is used as a base resin that is contained in resist used to form the resist film 200. As in the case of employing the above-mentioned conditions, use of such resin increases sag at the time of postbaking, whereby the slope angle θ1 of the end face of the resist film 200 can be reduced.

The slope angle θ1 of the resist film 200 can also be adjusted through adjustment of the time of developing resist in the course of formation of the resist film 200 from the resist. In order to obtain a relatively small slope angle θ1 as in the case of the present embodiment, resist is developed for a relatively long time. Specifically, resist is developed generally for about 60 seconds, whereas, in the present embodiment, resist is developed for a longer time. The slope angle θ1 of the resist film 200 can also be reduced by means of excessive exposure of resist used to form the resist film 2000; i.e., by means of increasing exposure time.

Figure 6A:
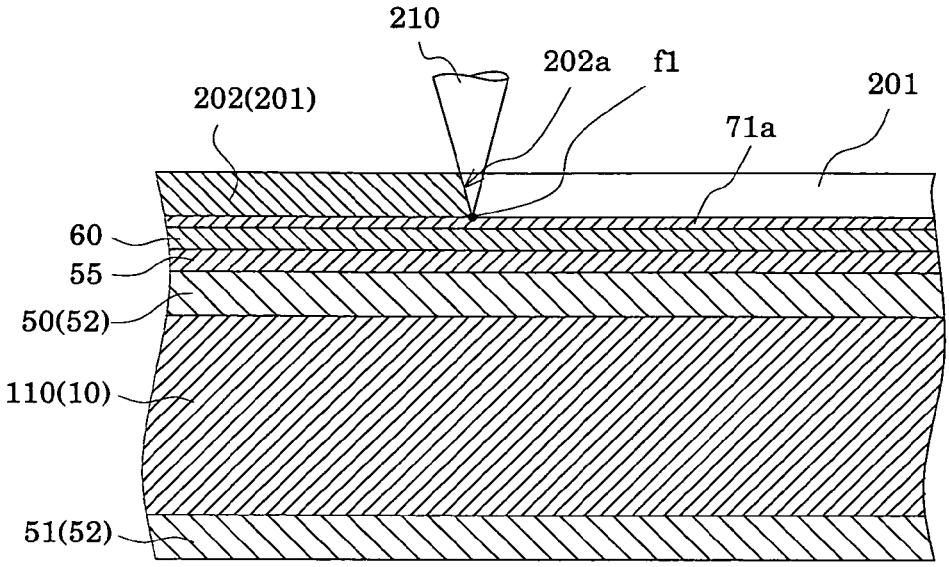
FIG. 6A and 6B are sectional views schematically showing an exposure step for resist.
Figure 6B:
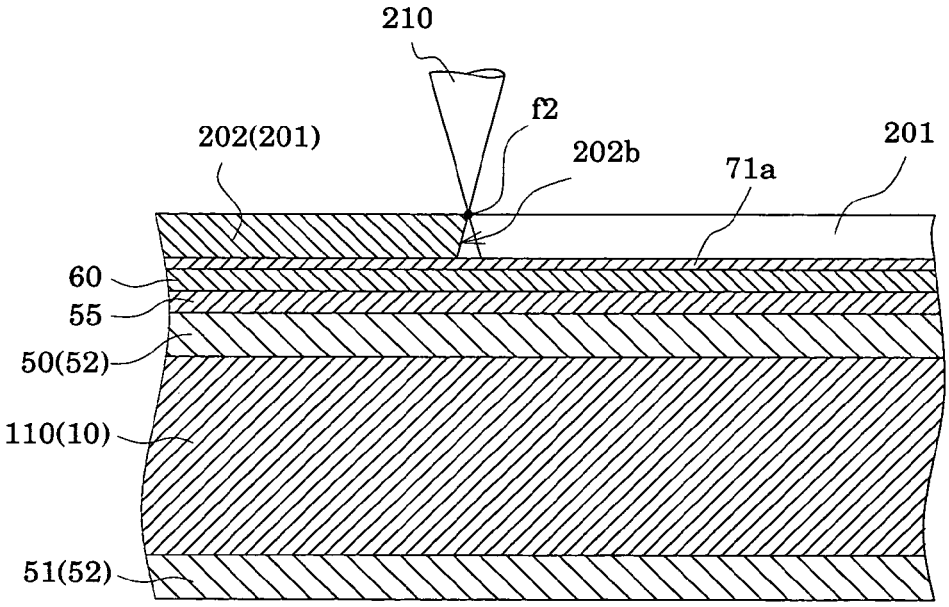

Furthermore, as shown in FIG. 6A, when a resist 201 used to form the resist film 200 is to be exposed to irradiation light 210, such as ultraviolet light, preferably, a focal point f1 of the irradiation light 210 is brought to the surface of the first ferroelectric film 71*a*; i.e., to the bottom surface of the resist 201, or to a position biased toward the lower electrode film 60 from the bottom surface. Since the angle of an end face 202*a* of an exposed resist 202 varies with the incident angle of the irradiation light 210 impinging on the resist 201, setting the focal point f1 to the above-mentioned position reduces the slope angle θ2 of the end face of the resist 201 to less than 90° with respect to the surface of the first ferroelectric film 71*a*. By means of developing and baking the thus-exposed resist 202 so as to form the resist film 200, the slope angle θ1 of the end face of the resist film 200 can be reduced to a desired angle with relative ease. As shown in FIG. 6B, when a focal point f2 of the irradiation light 210 is brought to a position biased toward the resist 201 from the surface of the first ferroelectric film 71*a*; e.g., to the surface of the resist 201, the slope angle of an end face 202*b* of the exposed resist 202 partially becomes greater than 90°. Thus, employment of the focal point f2 is unacceptable.

After the resist film 200 is formed as described above, as shown in FIG. 7A, the first ferroelectric film 71*a* and the lower electrode 60 are patterned by means of ion milling via the resist film 200. The resist film 200, together with the first ferroelectric film 71*a* and the lower electrode film 60, is gradually etched away. As a result, the end face of the lower electrode 60 and the end face of the first ferroelectric film 71*a* are sloped. In other words, the end face of the lower electrode film 60 and the end face of the first ferroelectric film 71*a* assume the same slope angle; in the present embodiment, a slope angle of about 25° with respect to the vibration plate.

By means of sloping the end face of the lower electrode film 60 and the end face of the ferroelectric film 71*a* at an angle of about 10° to 50° with respect to the vibration plate, other ferroelectric films can be formed with good film quality on the first ferroelectric film 71*a* in later steps.

Figure 7A:
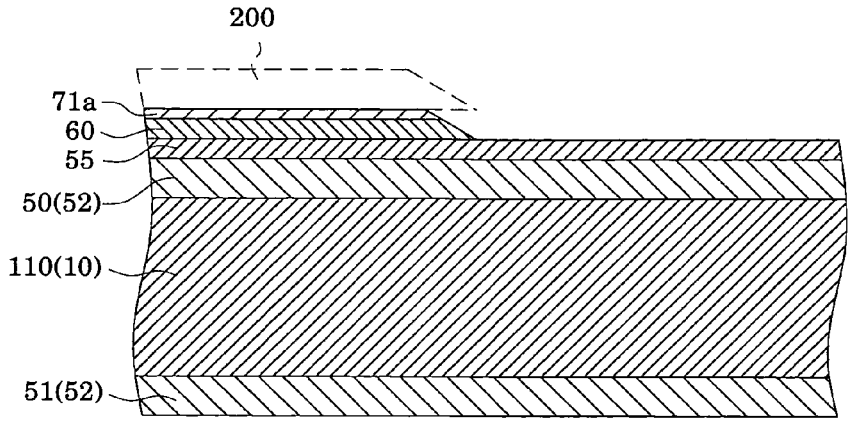
FIGS. 7A to 7C are sectional views showing steps of manufacturing the ink-jet recording head according to the embodiment.
Figure 7B:
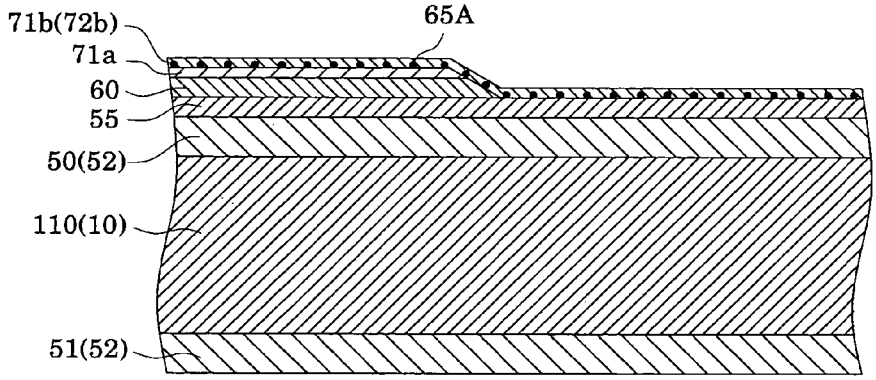

Next, as shown in FIG. 7B, crystal seeds (layer) 65A are formed on the entire surface of the silicon wafer 110 including the surface of the first ferroelectric film 71*a*. Subsequently, a ferroelectric precursor film 72*b* is formed by a spin-coating process or the like to a predetermined thickness; in the present embodiment, to a thickness of about 0.15 μm, such that thickness as measured after firing becomes about 0.1 μm. The ferroelectric precursor film 72*b* is dried, debindered, and fired to thereby become the second ferroelectric film 71*b*. As in the case of the first ferroelectric film 71*a*, in debindering the ferroelectric precursor film 72*b*, which will become the second ferroelectric film 71*b*, the rate of temperature increase is preferably set low. Employment of a low rate of temperature increase allows favorable generation of a large number of crystal nuclei in the ferroelectric precursor film 72*b*. In other words, the second ferroelectric film 71*b* is formed in a region corresponding to the lower electrode film 60 and in a region facing the insulator film 55 such that a large number of crystal nuclei are formed in a substantially uniform condition.

Figure 7C:
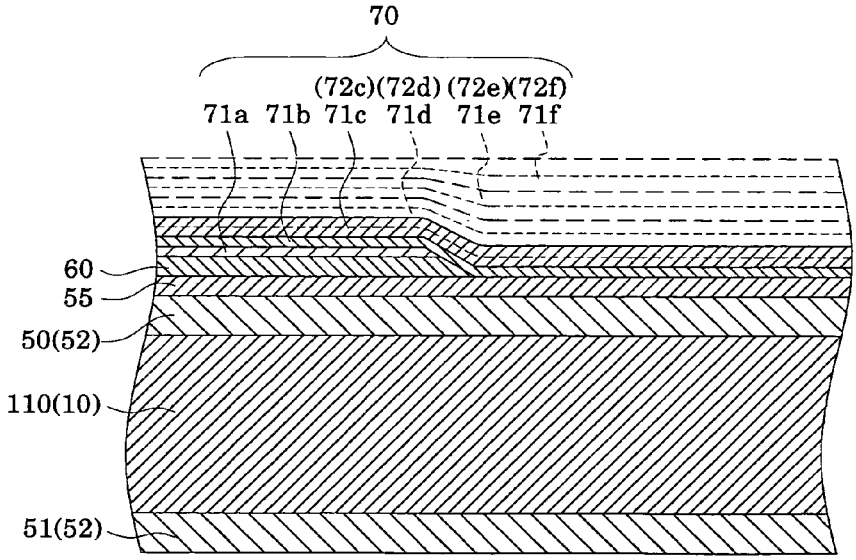

Next, as shown in FIG. 7C, a ferroelectric precursor film 72*c* is formed on the second ferroelectric film 71*b* to a predetermined thickness; in the present embodiment, to a thickness such that thickness as measured after firing becomes 0.2 μm. A single coating imparts a thickness of about 0.15 μm to the formed ferroelectric precursor film 72*c*. In the present embodiment, double coating is employed so as to impart the desired thickness to the formed ferroelectric precursor film 72*c*. Next, the ferroelectric precursor film 72*c* is dried and debindered and then fired for crystallization to thereby become the third ferroelectric film 71*c*. A step of forming a ferroelectric precursor film (72*c* to 72*f*) by means of double coating, and a step of drying, debindering, and firing the ferroelectric precursor film (72*c* to 72*f*) are repeated a plurality of times; in the present embodiment, four times, thereby forming the third to sixth ferroelectric films 71*c* to 71*f*. Thus is formed the piezoelectric layer 70 composed of a plurality of layers of ferroelectric films 71*a* to 71*f* and having a thickness of about 1 μm.

Preferably, in debindering the ferroelectric precursor films 72*c* to 72*f*, from which the third to sixth ferroelectric films 71*c* to 71*f* are formed respectively, the rate of temperature increase is set relatively high; for example, higher than that in debindering the ferroelectric precursor films 72*a* and 72*b*, from which the first and second ferroelectric films 71*a* and 71*b* are respectively formed. Employment of such a high rate of temperature increase hinders forming crystal nuclei in the ferroelectric precursor films 72*c* to 72*f*, from which the third to sixth ferroelectric films 71*c* to 71*f* are respectively formed. As a result, when the ferroelectric precursor films 72*c* to 72*f* are fired, crystals grow such that crystals of a previously crystallized ferroelectric film (the second ferroelectric film 71*b*) serve as nuclei for the crystal growth. In other words, crystals of the third to sixth ferroelectric films 71*c* to 71*f* assume preferred orientation and are grown in a columnar manner and continuously from crystals of the second ferroelectric film 71*b*. Thus, the ferroelectric films 71*b* to 71*f* are crystallized in a good condition and continuously over the entire region ranging from a region spreading above the lower electrode film 60 to a region spreading above the bare insulator film 55.

Preferred orientation refers to a state in which crystals are orderly oriented; i.e., certain crystal planes face the same direction. A thin film of columnar crystals refers to a state in which substantially cylindrical crystals are collected along the planar direction such that axes thereof extend substantially along the film thickness direction, to thereby form a thin film.

The present embodiment uses a lead zirconate titanate material to form the piezoelectric layer 70 (ferroelectric films 71), which is formed as described above. However, the present invention is not limited thereto. An ink-jet recording head may use any material for the piezoelectric layer 70 so long as the material exhibits favorable deflection characteristics.

Figure 8A:
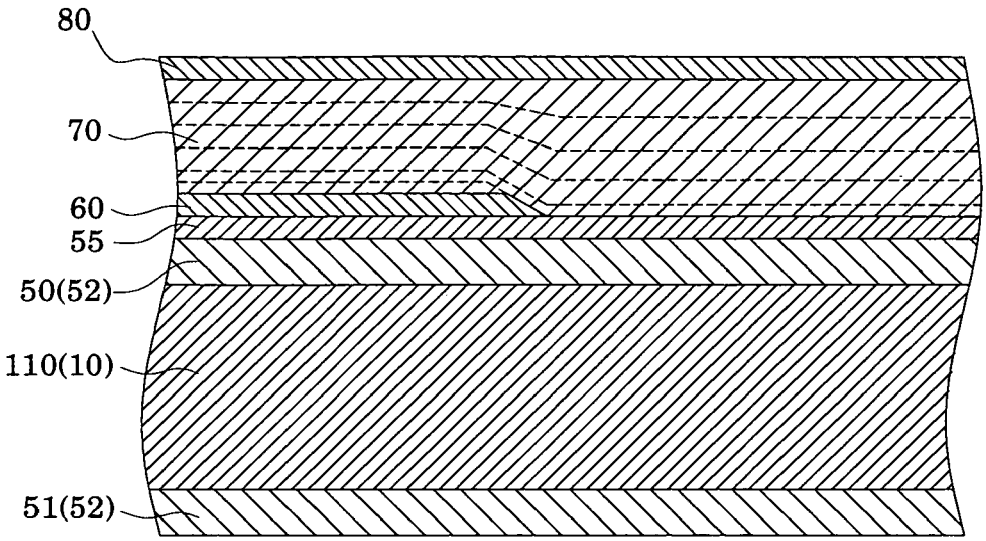
FIGS. 8A and 8B are sectional views showing steps of manufacturing the ink-jet recording head according to the embodiment.
Figure 8B:
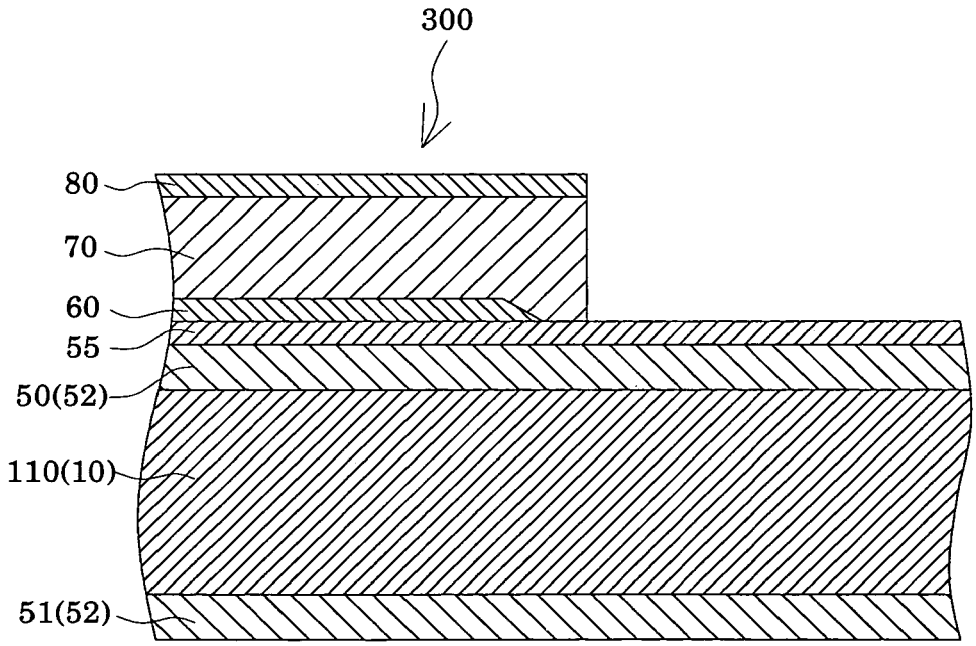

After formation of the piezoelectric layer 70 composed of a plurality of layers of ferroelectric films 71*a* to 71*f*, as shown in FIG. 8A, the upper electrode film 80 of, for example, iridium (Ir) is formed on the piezoelectric layer 70. The piezoelectric layer 70 and the upper electrode film 80 are patterned such that the piezoelectric elements 300 are formed in regions facing regions where the corresponding pressure generating chambers 12 are to be formed (FIG. 8B).

Figure 9A:
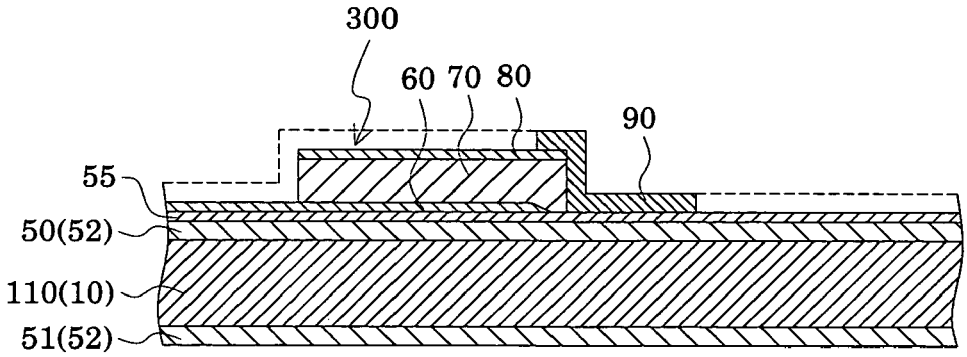
FIGS. 9A and 9B are sectional views showing steps of manufacturing the ink-jet recording head according to the embodiment.
Figure 9B:
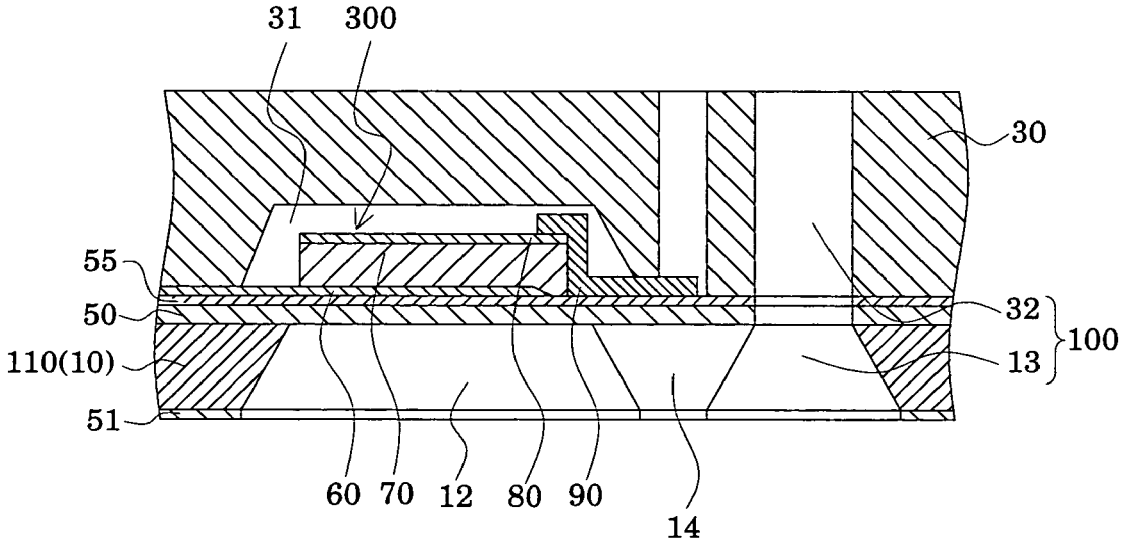

Subsequently, as shown in FIG. 9A, a metallic layer of gold (Au) is formed on the entire surface of the silicon wafer 110. The metallic layer is patterned via a mask pattern (not shown) of, for example, resist so as to form the lead electrodes 90 corresponding to the piezoelectric elements 300. Then, as shown in FIG. 9B, the sealing substrate 30 is bonded to the silicon wafer 110. The silicon wafer 110 is etched via the mask film 51, which is patterned to a predetermined pattern, thereby forming the pressure generating chambers 12 among others. In actual practice, a large number of chips are simultaneously formed on a single silicon wafer by means of a series of film formation steps as described above and anisotropic etching. Subsequently, the nozzle plate 20 and the compliance substrate 40 are bonded to the silicon wafer 110. The thus-prepared silicon wafer 110 is diced into chips each corresponding to the passage-forming substrate 10 shown in FIG. 1, thereby yielding ink-jet recording heads.

As described above, in the present invention, the lower electrode film 60 and the first ferroelectric film 71*a* are simultaneously patterned such that their end faces are sloped at an angle of about 10° to 50° with respect to the vibration plate. Employment of such end face feature improves crystallinity of the second to sixth ferroelectric films 71*b* to 71*f*, which are provided while overlying the sloped end faces, thereby enhancing crystal denseness and orientation. Specifically, according to the configuration of the present invention, since the lower electrode film 60 and the first ferroelectric film 71*a* gradually reduces in thickness of their end portions, a difference in the crystal growth direction is small among regions where the second to sixth ferroelectric films 71*b* to 71*f* are formed. Thus, the second to sixth ferroelectric films 71*b* to 71*f*, which are formed on the lower electrode film 60 and the first ferroelectric film 71*a*, are favorably crystallized over the entire region without involvement of impaired crystallinity, so that their film quality is enhanced, and their film quality becomes substantially uniform. Therefore, when voltage is applied to the piezoelectric elements 300, the piezoelectric elements 300 exhibit favorable deflection characteristics. Also, even when a relatively high voltage is applied to the piezoelectric elements 300, the piezoelectric layer 70 is not fractured, so that highly reliable piezoelectric elements 300 are obtained.

Test Example:

Piezoelectric elements of Examples 1 and 2 and Comparative Example were formed while the slope angle θ of the lower electrode film and the ferroelectric film was varied. The piezoelectric elements of Examples 1 and 2 and Comparative Example were subjected to a dielectric strength test and a durability test. Test results are shown below in Table 1. The"Fracture" column appearing in Table 1 indicates whether or not fracture is present in a piezoelectric element at a portion in the vicinity of the lower electrode film. Durability test conditions were as follows: applied voltage: 25 V; and number of applied pulses: 8 billion.

TABLE 1

| | | Dielectric Strength Test | | Durability Test |
|---|---|---|---|---|
| | Slope Angle θ | Applied Voltage | Fracture | Fracture |
| Example 1 | 30° | 115 V | Absent | Absent |
| Example 2 | 40° | 110 V | Absent | Absent |
| Comparative Example | 60° | 65 V | Present | Present |

As shown in Table 1, the piezoelectric elements of Examples 1 and 2 exhibited no fracture even when a voltage equal to or higher than 110 V was applied in the dielectric strength test, and exhibited no fracture in the durability test. By contrast, a piezoelectric element of Comparative Example exhibited fracture in the dielectric strength test when a voltage of 65 V, which is far lower than the voltage applied to the piezoelectric elements of Examples, was applied, and exhibited fracture in the durability test.

Furthermore, a predetermined voltage was applied-to a piezoelectric element of Example 3; which was formed such that the lower electrode film and the first ferroelectric film assumed a slope angle θ of about 20°, as well as to a piezoelectric element of Comparative Example, which was formed such that the slope angle θ was about 60°. Then, the tested piezoelectric elements were examined for the condition of the piezoelectric layer 70. FIG. 10 shows the TEM images of the tested piezoelectric elements.

Figure 10A:
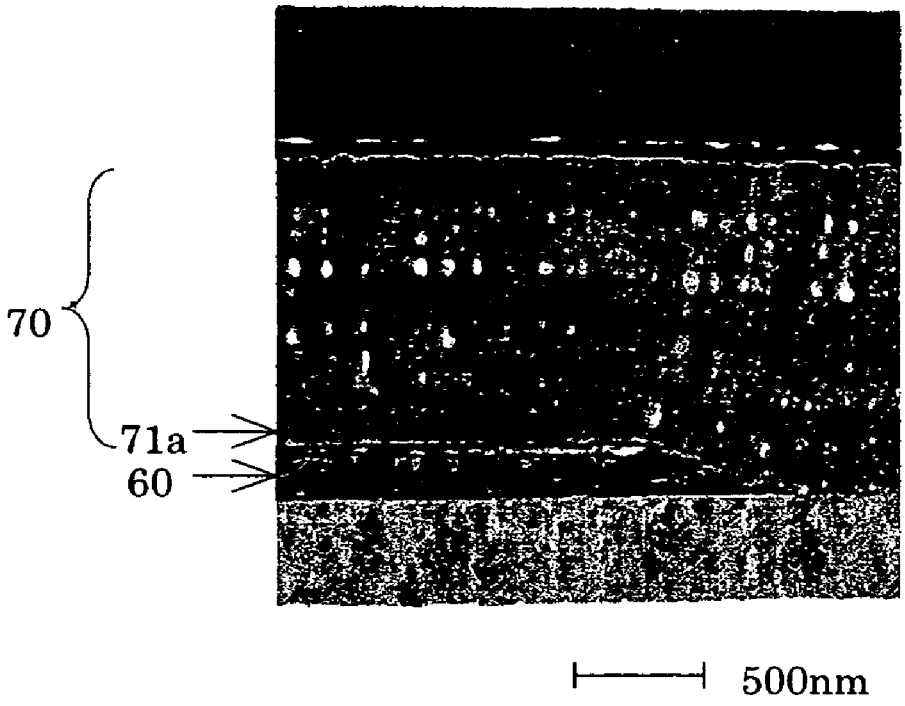
FIGS. 10A and 10B are TEM images of a piezoelectric element of Example 3 and a piezoelectric element of Comparative Example.
Figure 10B:
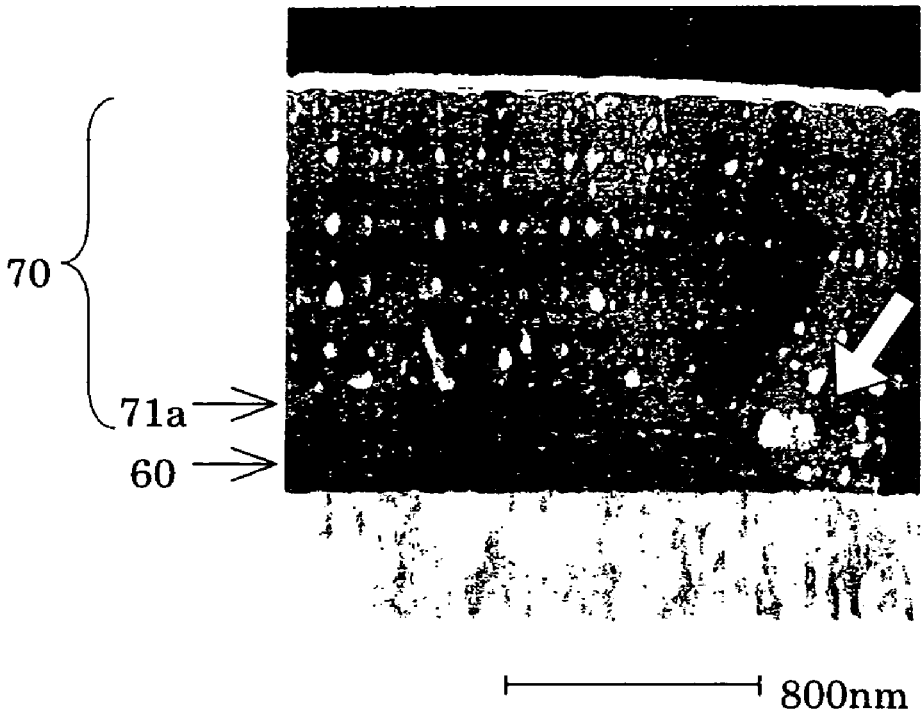

As shown in FIG. 10A, in the case of the piezoelectric element of Example 3, even when a voltage of 110 V was applied, the piezoelectric layer 70 was free of cracking. By contract, as shown in FIG. 10B, in the case of the piezoelectric element of Comparative Example, the piezoelectric layer 70 exhibited occurrence of cracking (indicated by the arrow in FIG. 10B) at a portion in the vicinity of an end portion of the lower electrode film 60. As is apparent from the test results, by means of sloping the end face of the lower electrode film 60 and the end face of the ferroelectric film 71*a* at an angle of about 10° to 50° with respect to the vibration plate, even when a relatively high voltage is applied, the piezoelectric layer 70 is not fractured, so that the piezoelectric elements 300 can be formed with excellent reliability.

OTHER EMBODIMENTS

While the present invention has been described with reference to an embodiment, the present invention is not limited thereto. For example, in the above-described embodiment, the third to sixth ferroelectric films 71*c* to 71*f* are formed on the second ferroelectric film 71*b* such that, after each of the ferroelectric precursor films 72*c* to 72*f* is formed by means of double coating, each of the ferroelectric precursor films 72*c* to 72*f* is fired. However, each of the ferroelectric precursor films 72*c* to 72*f* may be formed by means of a single coating, followed by firing. In the above-described embodiment, the lower electrode film 60 is provided continuously over a region corresponding to the pressure generating chambers 12, which are arranged in proximity in a row arrangement condition. However, the present invention is not limited thereto. For example, the lower electrode film 60 may be formed into a comb-toothed shape such that the lower electrode films 60 are provided in a substantially independent manner in regions corresponding to the pressure generating chambers 12.

Figure 11:
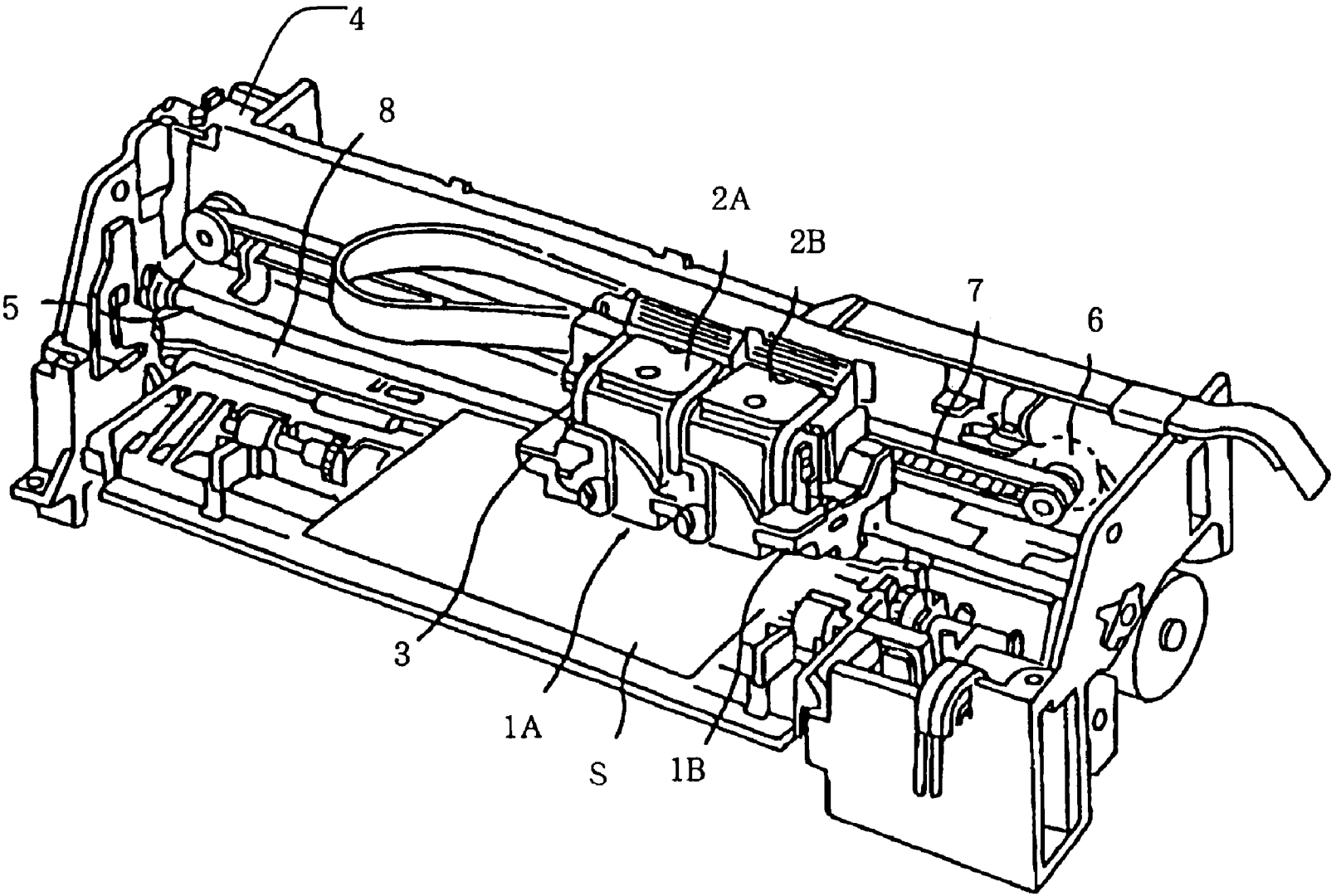
FIG. 11 is a schematic view of an ink-jet recording apparatus according to an embodiment of the present invention.

Each of the ink-jet recording heads of the above embodiments partially constitutes a recording head unit, which includes an ink channel communicating with an ink cartridge or a like device, to thereby be mounted on an ink-jet recording apparatus. FIG. 11 schematically shows an example of such an ink-jet recording apparatus. As shown in FIG. 11, recording head units 1A and 1B each including an ink-jet recording head removably carry cartridges 2A and 2B, respectively. The cartridges 2A and 2B serve as ink supply means. A carriage 3 that carries the recording head units 1A and 1B is mounted, in an axially movable condition, on a carriage shaft 5, which is attached to an apparatus body 4. The recording head units 1A and 1B are adapted to eject, for example, a black ink composition and a color ink composition, respectively. Driving force of a drive motor 6 is transmitted to the carriage 3 via a plurality of unillustrated gears and a timing belt 7, whereby the carriage 3, which carries the recording head units 1A and 1B, is moved along the carriage shaft 5. A platen 8 is provided on the apparatus body 4 in such a manner as to extend along the carriage shaft 5. A recording sheet S is fed onto the platen 8. The recording sheet S is, for example, paper, which is fed by means of unillustrated paper feed rollers.

The present invention has been described while mentioning an ink-jet recording head for ejecting ink as a liquid-jet head. However, the present invention is intended for application to various liquid-jet heads and liquid-jet apparatus. Examples of a liquid-jet head include a recording head for use in image recording apparatus such as printers; a head for ejecting liquid that contains color materials for use in manufacture of color filters for liquid crystal displays and the like; a head for ejecting liquid that contains electrode materials for use in manufacture of electrodes for organic EL displays, FEDs (field emission displays), and the like; and a head for ejecting liquid that contains bioorganic compounds for use in manufacture of biochips.

Moreover, the present invention can be applied not only to actuator devices mounted on liquid-jet heads (ink-jet recording heads), but also to actuator devices mounted on all sorts of apparatuses. For example, the actuator devices can be applied to sensors among others, in addition to the above-described heads.

What is claimed is:

1. A liquid-jet head comprising:

a passage-forming substrate having a pressure generating chamber, the pressure generating chamber being formed in the passage-forming substrate and communicates with a nozzle orifice for ejecting liquid; and a piezoelectric element provided on one side of the passage-forming substrate via a vibration plate, the piezoelectric element comprising a lower electrode, a piezoelectric layer, and an upper electrode, wherein the lower electrode is patterned such that at least one end face thereof is located in a region facing the pressure generating chamber;

the piezoelectric layer comprises a plurality of layers of ferroelectric films;

a first ferroelectric film, which is a lowermost layer of the plurality of layers of ferroelectric films, is provided only on the lower electrode such that an end face thereof is aligned with the end face of the lower electrode;

the end face of the first ferroelectric film and the end face of the lower electrode are sloped at an angle of 10° to 50° with respect to the vibration plate; and other ferroelectric films formed on the first ferroelectric film are provided in such a manner as to overlie the sloped end face of the lower electrode and the sloped end face of the first ferroelectric film.

2. A liquid-jet head according to claim 1, wherein the end face of the first ferroelectric film and the end face of the lower electrode are sloped at an angle equal to or less than 40°.

3. A liquid-jet head according to claim 1, wherein the first ferroelectric film and a second ferroelectric film formed on the first ferroelectric film are thinner than each of other, remaining ferroelectric films formed on the second ferroelectric film.

4. A liquid-jet head according to claims 1, wherein crystal seeds, which serve as crystal nuclei of the piezoelectric layer, are formed on the first ferroelectric film and on the vibration plate in a continuously overlying manner.

5. A liquid-jet apparatus comprising a liquid-jet head according to any one of claims 1 to 4.

6. An actuator device comprising:

a substrate;

a vibration plate provided on one face of the substrate; and a piezoelectric element provided on the vibration plate and including a lower electrode, a piezoelectric layer, and an upper electrode, wherein the lower electrode of the piezoelectric element is formed through patterning;

the piezoelectric layer comprises a plurality of layers of ferroelectric films;

a first ferroelectric film, which is a lowermost layer of the plurality of layers of ferroelectric films, is provided only on the lower electrode such that an end face thereof is aligned with the end face of the lower electrode;

the end face of the first ferroelectric film and the end face of the lower electrode are sloped at an angle of 10° to 50° with respect to the vibration plate; and other ferroelectric films formed on the first ferroelectric film are provided in such a manner as to overlie the sloped end face of the lower electrode and the sloped end face of the first ferroelectric film.

7. An actuator device according to claim 6, wherein the end face of the first ferroelectric film and the end face of the lower electrode are sloped at an angle equal to or less than 40°.

8. An actuator device according to claim 6, wherein the first ferroelectric film and a second ferroelectric film formed on the first ferroelectric film are thinner than each of other, remaining ferroelectric films formed on the second ferroelectric film.

9. An actuator device according to claims 6, wherein crystal seeds, which serve as crystal nuclei of the piezoelectric layer, are formed on the first ferroelectric film and on the vibration plate in a continuously overlying manner.

* * * * *